US011448415B2

(12) United States Patent
Longenecker

(10) Patent No.: US 11,448,415 B2
(45) Date of Patent: Sep. 20, 2022

(54) AUTO-ADJUSTING FAN ASSEMBLY FOR AN AIR CONDITIONING APPLIANCE

(71) Applicant: Haier US Appliance Solutions, Inc., Wilmington, DE (US)

(72) Inventor: Joshua Duane Longenecker, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 261 days.

(21) Appl. No.: 16/916,665

(22) Filed: Jun. 30, 2020

(65) Prior Publication Data

US 2021/0404692 A1 Dec. 30, 2021

(51) Int. Cl.

| | |
|---|---|
| ***F24F 11/74*** | (2018.01) |
| ***F24F 1/022*** | (2019.01) |
| ***F24F 11/32*** | (2018.01) |
| ***F24F 11/64*** | (2018.01) |
| ***F24F 11/65*** | (2018.01) |
| ***F24F 1/0022*** | (2019.01) |
| *F24F 140/00* | (2018.01) |
| *F24F 1/0011* | (2019.01) |
| *F24F 13/06* | (2006.01) |

(52) U.S. Cl.

CPC ..... *F24F 11/74* (2018.01); *F24F 1/0022* (2013.01); *F24F 11/32* (2018.01); *F24F 11/64* (2018.01); *F24F 11/65* (2018.01); *F24F 1/0011* (2013.01); *F24F 13/06* (2013.01); *F24F 2140/00* (2018.01)

(58) Field of Classification Search

CPC ..... F24F 11/74; F24F 1/0022; F24F 11/32; F24F 11/64; F24F 11/65; F24F 1/0011; F24F 13/06; F24F 2140/00; F24F 2110/30; F24F 1/022; F24F 1/028; F24F 1/0284; F24F 11/77

See application file for complete search history.

(56) References Cited

U.S. PATENT DOCUMENTS

| | | | | |
|---|---|---|---|---|
| 11,168,916 | B2 * | 11/2021 | Blanchard | F24F 11/0001 |
| 11,187,425 | B2 * | 11/2021 | Mowris | F24F 11/755 |
| 11,255,558 | B1 * | 2/2022 | Kraft | F24F 11/30 |
| 2010/0082162 | A1 * | 4/2010 | Mundy | F24F 3/044 700/277 |

(Continued)

FOREIGN PATENT DOCUMENTS

| | | |
|---|---|---|
| CN | 1752632 A | 3/2006 |
| CN | 204436846 U | 7/2015 |

(Continued)

*Primary Examiner* — Ramesh B Patel

(74) *Attorney, Agent, or Firm* — Dority & Manning, P.A.

(57) ABSTRACT

An air conditioner unit is configured for automatically detecting a restricted duct and adjusting fan speed schedules in response. The air conditioner unit includes an indoor fan including a drive motor for selectively rotating the indoor fan to urge a flow of air through the indoor portion and a controller is configured for sending a control signal to the drive motor to rotate the indoor fan to an actual fan speed. Based on the actual fan speed and a unit voltage, the controller obtains a target control signal, e.g., via a lookup table, and determines that a restricted duct condition exists if the control signal is different than the target control signal. The controller adjusts the operation of the indoor fan in response to determining that the restricted duct condition exists.

20 Claims, 4 Drawing Sheets

(56) References Cited

U.S. PATENT DOCUMENTS

| | | | | |
|---|---|---|---|---|
| 2013/0095745 | A1* | 4/2013 | Davledzarov | F24F 13/1426 454/333 |
| 2017/0115025 | A1* | 4/2017 | Mowris | F24F 11/77 |
| 2017/0268797 | A1* | 9/2017 | Mowris | F24D 19/1084 |
| 2019/0195523 | A1* | 6/2019 | Mowris | F24F 11/77 |
| 2019/0226353 | A1* | 7/2019 | Karpman | F01D 21/14 |
| 2019/0226407 | A1* | 7/2019 | Karpman | G05B 13/041 |
| 2019/0293305 | A1* | 9/2019 | Henderson | F24F 11/30 |
| 2020/0240672 | A1* | 7/2020 | Patil | F24F 11/81 |
| 2020/0340704 | A1* | 10/2020 | Ross | F24F 11/30 |
| 2021/0071881 | A1* | 3/2021 | Shaffer | F24F 1/027 |
| 2021/0071888 | A1* | 3/2021 | Mowris | F24F 11/755 |

FOREIGN PATENT DOCUMENTS

| | | | |
|---|---|---|---|
| JP | 2945832 | B2 | 9/1999 |
| KR | 20180007202 | A | 1/2018 |

* cited by examiner

AUTO-ADJUSTING FAN ASSEMBLY FOR AN AIR CONDITIONING APPLIANCE

FIELD OF THE INVENTION

The present subject matter relates generally to air conditioning appliances, and more particularly to fan assemblies for air conditioning appliances.

BACKGROUND OF THE INVENTION

Air conditioner or conditioning units are conventionally utilized to adjust the temperature indoors, e.g., within structures such as dwellings and office buildings. Such units commonly include a closed refrigeration loop to heat or cool the indoor air. Typically, the indoor air is recirculated while being heated or cooled. A variety of sizes and configurations are available for such air conditioner units. For example, some units may have one portion installed within the indoors that is connected to another portion located outdoors, e.g., by tubing or conduit carrying refrigerant. These types of units are typically used for conditioning the air in larger spaces.

Another type of air conditioner unit, commonly referred to as single-package vertical units (SPVU), or package terminal air conditioners (PTAC) may be utilized to adjust the temperature in, for example, a single room or group of rooms of a structure. These units typically operate like split heat pump systems, except that the indoor and outdoor portions are defined by a bulkhead and all system components are housed within a single package. In this regard, such units commonly include an indoor portion that communicates (e.g., exchanges air) with the area within a building and an outdoor portion that generally communicates (e.g., exchanges air) with the area outside a building. Accordingly, the air conditioner unit generally extends through, for example, an outer wall of the structure, or is otherwise ducted to the outdoors.

Notably, PTACs, SPVUs, and other air conditioner units frequently have different installation locations and requirements that can result in varying unit performance. For example, when an end user installs such air conditioner units, the duct length may vary significantly, e.g., depending on room size and configuration. In addition, other restrictions may affect airflow to and from the unit, e.g., due to restrictive grills, installation positions, or other duct restrictions. The airflow through the air conditioner unit may vary significantly depending on these factors, and conventional air conditioner units fail to adequately account for such factors. Certain conventional air conditioner units may permit manual adjustment of the fan speed, but end users often fail to correctly set the fan speed, or make no adjustments at all, thus resulting in degraded performance of the unit, e.g., poor cooling or heat pump capacity, poor efficiency, etc.

Accordingly, improved air conditioner units having improved fan assemblies would be useful. More specifically, a fan assembly and associated method of operation that can compensate for installation conditions that might affect airflow through the unit would be particularly beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an air conditioner unit is provided defining a vertical, a lateral, and a transverse direction. The air conditioner unit includes a bulkhead positioned within a cabinet and defining an indoor portion and an outdoor portion, an indoor fan including a drive motor for selectively rotating the indoor fan to urge a flow of air through the indoor portion, and a controller operably coupled to the indoor fan. The controller is configured for sending a control signal to the drive motor to rotate the indoor fan, determining an actual fan speed of the indoor fan, obtaining a target control signal based at least in part on the actual fan speed of the indoor fan, determining that a restricted duct condition exists if the control signal is different than the target control signal, and adjusting the operation of the indoor fan in response to determining that the restricted duct condition exists.

In another exemplary aspect of the present disclosure, a method of operating an indoor fan of an air conditioner unit is provided. The indoor fan includes a drive motor for selectively rotating the indoor fan to urge a flow of air through an indoor portion of the air conditioner unit. The method includes sending a control signal to the drive motor to rotate the indoor fan, determining an actual fan speed of the indoor fan, obtaining a target control signal based at least in part on the actual fan speed of the indoor fan, determining that a restricted duct condition exists if the control signal is different than the target control signal, and adjusting the operation of the indoor fan in response to determining that the restricted duct condition exists.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
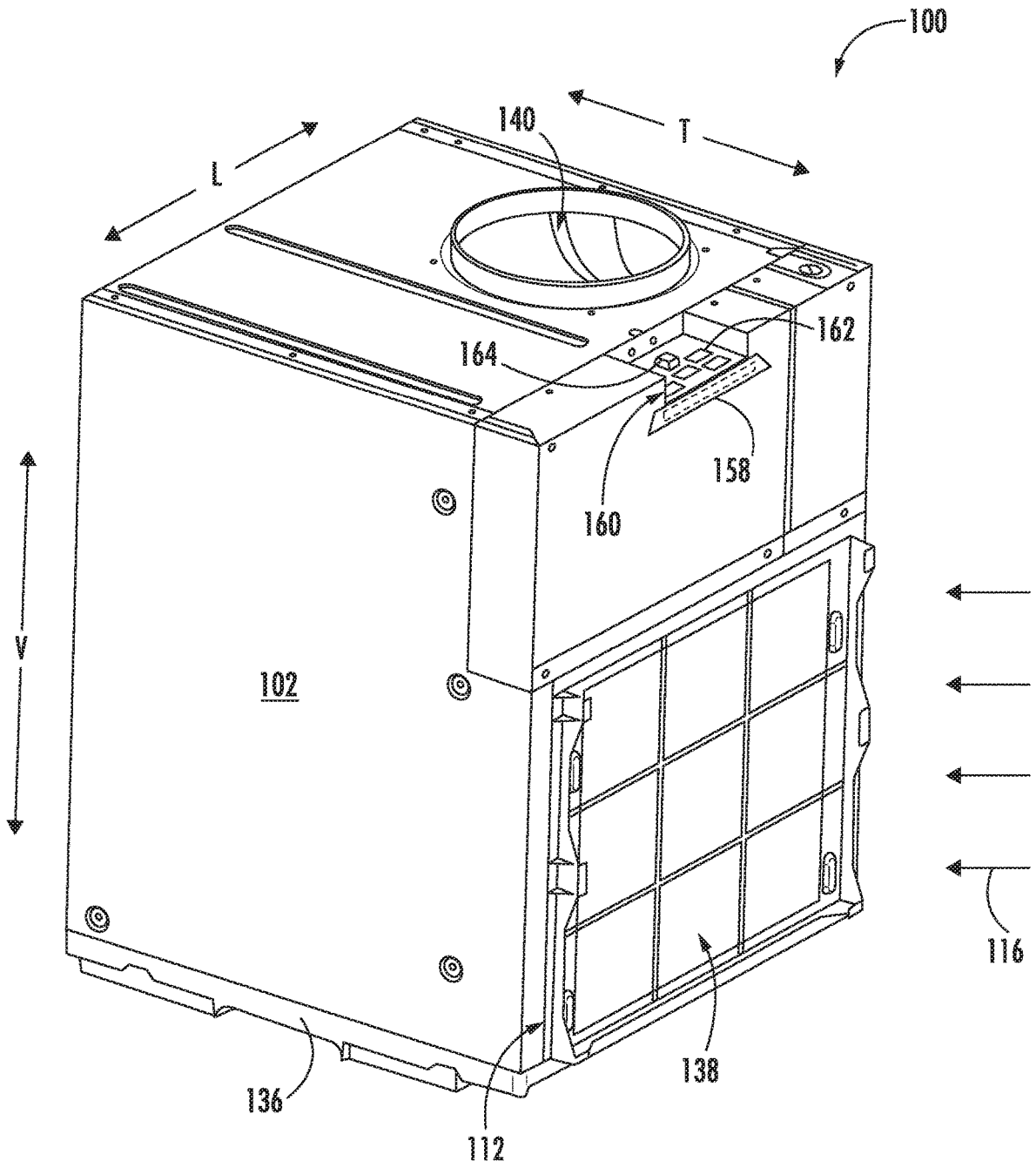
FIG. 1 provides a perspective view of an air conditioning appliance according to one or more exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. As used herein, terms of approximation, such as "substantially," "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
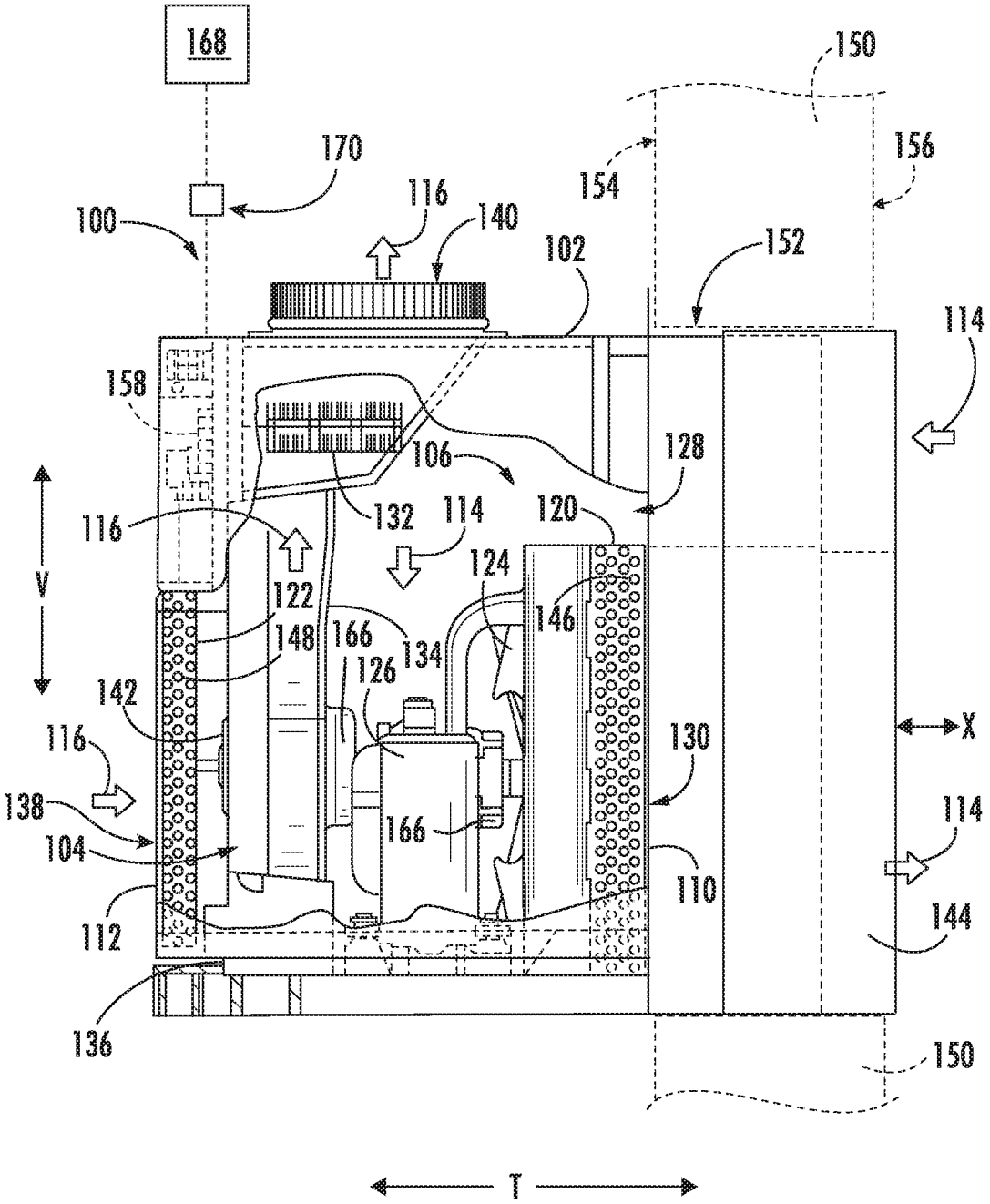
FIG. 2 provides a section view of the exemplary air conditioning appliance of FIG. 1.

Turning now to the figures, FIGS. 1 and 2 illustrate an exemplary air conditioner appliance (e.g., air conditioner 100). Specifically, FIG. 1 provides a perspective view and FIG. 2 provides a cross sectional view of air conditioner 100. As shown, air conditioner 100 may be provided as a one-unit type air conditioner 100, such as a single-package vertical unit (SPVU). However, it should be appreciated that aspects of the present subject matter may be used with other suitable air conditioning units or air filtering devices, such as a packaged terminal air conditioner unit (PTAC), a split heat pump system, etc.

Air conditioner 100 includes a package housing or cabinet 102 supporting and defining an indoor portion 104 and an outdoor portion 106. Generally, air conditioner 100 generally defines a vertical direction V, a lateral direction L, and a transverse direction T. Each direction V, L, T is perpendicular to each other, such that an orthogonal coordinate system is generally defined.

In some embodiments, cabinet 102 contains various other components of the air conditioner 100. Cabinet 102 may include, for example, a rear opening 110 (e.g., with or without a grill or grate thereacross) and a front opening 112 (e.g., with or without a grill or grate thereacross) may be spaced apart from each other along the transverse direction T. The rear opening 110 may be part of the outdoor portion 106, while the front opening 112 is part of the indoor portion 104. Components of the outdoor portion 106, such as an outdoor heat exchanger 120, outdoor fan 124, and compressor 126 may be enclosed within cabinet 102 between front opening 112 and rear opening 110. In certain embodiments, one or more components of outdoor portion 106 are mounted on a base 136, as shown. According to exemplary embodiments, base 136 may be received within a drain pan, e.g., for collecting condensation formed during operation.

During certain operations, air 114 may be drawn to outdoor portion 106 through rear opening 110. Specifically, an outdoor inlet 128 defined through cabinet 102 may receive outdoor air 114 motivated by outdoor fan 124. Within cabinet 102, the received outdoor air 114 may be motivated through or across outdoor fan 124. Moreover, at least a portion of the outdoor air 114 may be motivated through or across outdoor heat exchanger 120 before exiting the rear opening 110 at an outdoor outlet 130. It is noted that although outdoor inlet 128 is illustrated as being defined above outdoor outlet 130, alternative embodiments may reverse this relative orientation (e.g., such that outdoor inlet 128 is defined below outdoor outlet 130) or provide outdoor inlet 128 beside outdoor outlet 130 in a side-by-side orientation, or another suitable orientation.

As shown, indoor portion 104 may include an indoor heat exchanger 122, an indoor fan 142, and a heating unit 132. These components may, for example, be housed behind the front opening 112. A bulkhead 134 may generally support or house various other components or portions thereof of the indoor portion 104, such as the indoor fan 142. Bulkhead 134 may generally separate and define the indoor portion 104 and outdoor portion 106 within cabinet 102. Additionally, or alternatively, bulkhead 134 or indoor heat exchanger 122 may be mounted on base 136 (e.g., at a higher vertical position than outdoor heat exchanger 120), as shown.

During certain operations, air 116 may be drawn to indoor portion 104 through front opening 112. Specifically, an indoor inlet 138 defined through cabinet 102 may receive indoor air 116 motivated by indoor fan 142. At least a portion of the indoor air 116 may be motivated through or across indoor heat exchanger 122 (e.g., before passing to bulkhead 134). From indoor fan 142, indoor air 116 may be motivated (e.g., across heating unit 132) and returned to the indoor area of the room through an indoor outlet 140 defined through cabinet 102 (e.g., above indoor inlet 138 along the vertical direction V). Optionally, one or more conduits (see, e.g., FIG. 3) may be mounted on or downstream from indoor outlet 140 to further guide air 116 from air conditioner 100. It is noted that although indoor outlet 140 is illustrated as generally directing air upward, it is understood that indoor outlet 140 may be defined in alternative embodiments to direct air in any other suitable direction.

Air conditioner unit 100 may further include one or more drive motors 166 for selectively rotating each of outdoor fan 124 and indoor fan 142 to circulate outdoor air 114 and indoor air 116, respectively. As used herein, "motor" may refer to any suitable drive motor and/or transmission assembly for rotating indoor fan 142 and/or outdoor fan 124. For example, each motor 166 may be a brushless DC electric motor, a stepper motor, or any other suitable type or configuration of motor. According to still other embodiments, each motor 166 may be an AC motor, an induction motor, a permanent magnet synchronous motor, or any other suitable type of AC motor. In addition, motors 166 may include any suitable transmission assemblies, clutch mechanisms, or other components.

Outdoor and indoor heat exchanger 120, 122 may be components of a thermodynamic assembly (i.e., sealed system), which may be operated as a refrigeration assembly (and thus perform a refrigeration cycle) or, in the case of the heat pump unit embodiment, a heat pump (and thus perform a heat pump cycle). Thus, as is understood, exemplary heat pump unit embodiments may be selectively operated perform a refrigeration cycle at certain instances (e.g., while in a cooling mode) and a heat pump cycle at other instances (e.g., while in a heating mode). By contrast, exemplary A/C exclusive unit embodiments may be unable to perform a heat pump cycle (e.g., while in the heating mode), but still perform a refrigeration cycle (e.g., while in a cooling mode).

The sealed system may, for example, further include compressor 126 (e.g., mounted on base 136) and an expansion device (e.g., expansion valve or capillary tube—not pictured), both of which may be in fluid communication with the heat exchangers 120, 122 to flow refrigerant therethrough, as is generally understood. The outdoor and indoor heat exchanger 120, 122 may each include coils 146, 148, as illustrated, through which a refrigerant may flow for heat exchange purposes, as is generally understood.

According to exemplary embodiments, air conditioner 100 may further include a plenum 144 to direct air to or from cabinet 102. When installed, plenum 144 may be selectively attached to (e.g., fixed to or mounted against) cabinet 102 (e.g., via a suitable mechanical fastener, adhesive, gasket, etc.) and extend through a structure wall 150 (e.g., an outer wall of the structure within which air conditioner 100 is installed) and above a floor of the structure. In particular, plenum 144 extends along an axial direction X (e.g., parallel to the transverse direction T) through a hole or channel 152 in the structure wall 150 that passes from an internal surface 154 to an external surface 156. In addition, it should be appreciated that plenum 144 may be formed from two or more telescoping structures, e.g., to accommodate different thicknesses of structure wall 150.

The operation of air conditioner 100 including compressor 126 (and thus the sealed system generally), indoor fan 142, outdoor fan 124, heating unit 132, and other suitable components may be controlled by a control board or controller 158. Controller 158 may be in communication (via for example a suitable wired or wireless connection) to such components of the air conditioner 100. By way of example, the controller 158 may include a memory and one or more processing devices such as microprocessors, CPUs or the like, such as general or special purpose microprocessors operable to execute programming instructions or micro-control code associated with operation of air conditioner 100. The memory may be a separate component from the processor or may be included onboard within the processor. The memory may represent random access memory such as DRAM, or read only memory such as ROM or FLASH.

Air conditioner 100 may additionally include a control panel 160 and one or more user inputs 162, which may be included in control panel 160. The user inputs 162 may be in communication with the controller 158. A user of the air conditioner 100 may interact with the user inputs 162 to operate the air conditioner 100, and user commands may be transmitted between the user inputs 162 and controller 158 to facilitate operation of the air conditioner 100 based on such user commands. A display 164 may additionally be provided in the control panel 160, and may be in communication with the controller 158. Display 164 may, for example be a touchscreen or other text-readable display screen, or alternatively may simply be a light that can be activated and deactivated as required to provide an indication of, for example, an event or setting for the air conditioner 100.

It should be appreciated that controller 158 may be in operative communication with drive motor(s) 166 for controlling operation of drive motor(s) 166. In this regard, controller 158 may control the operation of indoor fan 142, e.g., by directly or indirectly providing the desired amount of power and/or a control signal to indoor fan 142 to achieve the target rotational speed. For example, controller 158 is described herein as regulating the operation of indoor fan 142 through use of a control signal. As used herein, the term "control signal" may be used to refer to any suitable signal, voltage, or other instruction generated by controller 158 to regulate operation of the drive motor.

According to exemplary embodiments, controller 158 may regulate operation of indoor fan 142 by varying an input voltage or power applied by an external power source 168, e.g., mains electricity provided at any suitable voltage. In this regard, the applied voltage may be referred to herein as the control signal. According to exemplary embodiments, air conditioner unit 100 may further include a voltage sensing device 170, e.g., mounted directly controller 158 or on an electrical connection with external power source. Voltage sensing device 170 may generally monitor unit voltage, which may for example by a standard supply voltage (e.g., 208 V, 230 V, 280 V, etc.). Notably, supply voltage may frequently vary, e.g., depending on fluctuations from external power source 168. These fluctuations can affect the operation of indoor fan 142 and corresponding generated airflow.

Alternatively, the power level of drive motor 166 may be adjusted by manipulating a control signal, such as any suitable digital control signal. For example, the control signal may be a pulse width modulated signal having a duty cycle that is roughly proportional to the power level of motor 166. In this regard, for example, a fifty percent duty cycle may drive indoor fan 142 at fifty percent of its rated speed, an eighty percent duty cycle may drive indoor fan 142 at eighty percent of its rated speed, etc. According to alternative embodiments, the control signal may be a control signal that varies between 0 volts and 5 volts, with a 5-volt control signal corresponding to a rated voltage and power level of motor 166. It should be appreciated that other means for controlling the power level and speed of motor 166 and indoor fan 142 are possible and within the scope of the present subject matter.

It should be appreciated that any suitable measurement method, sampling rate, or measured variables may be used as a proxy for motor voltage, power, operating speed, etc. For example, according to an exemplary embodiment, motor current and/or voltage is measured and used as a proxy for motor speed, motor speed may be used as a proxy for fan speed, etc. In addition, motor voltage may be approximated using system or appliance voltage. According to an exemplary embodiment, motor speed may be determined by measuring a motor frequency, a back electromotive force (EMF) on the motor, or a motor shaft speed (e.g., using a tachometer). It should be appreciated that other systems and methods for monitoring motor power and/or fan speeds may be used while remaining within the scope of the present subject matter.

Figure 3:
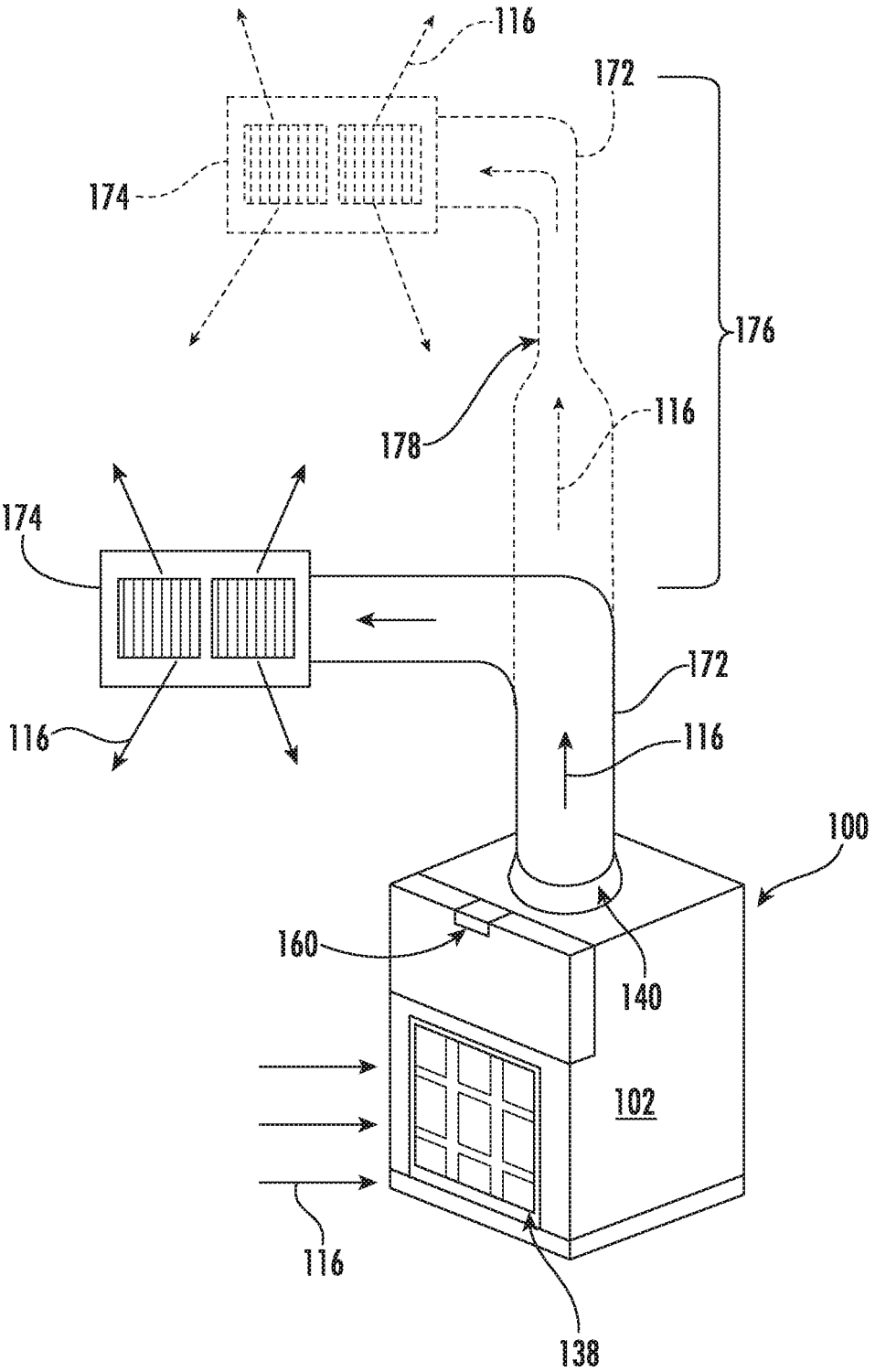
FIG. 3 provides a schematic view of a duct system for use with the exemplary air conditioning appliance of FIG. 1, with a shorter duct shown in solid lines and a longer duct shown in dotted lines.

Referring now briefly to FIG. 3, an exemplary installation of air conditioner unit 100 will be described according to exemplary embodiments of the present subject matter. Specifically, FIG. 3 illustrates an exemplary indoor duct system (the outdoor duct system is omitted for clarity). As shown, indoor fan 142 is configured for circulating or urging a flow of indoor air 116 through indoor portion 104. Specifically, indoor air 116 is drawn through indoor inlet 138, over indoor heat exchanger 122, and is discharged through indoor outlet 140. After exiting indoor outlet 140, indoor air 116 may pass through an indoor duct system, identified herein for simplicity as indoor duct 172. Although a single indoor duct 172 is illustrated, it should be appreciated that the indoor duct system may include several split ducts having any suitable size, length, orientation, and configuration as needed for a particular installation. As shown, each duct 172 may terminate in an exhaust vent 174, which may be mounted to an interior wall, ceiling, or other location within a room for discharging indoor air 116 back into the room.

As shown in solid lines, indoor duct 172 is typically a relatively short duct with few or no flow restrictions. Such installation may be referred to herein as a "standard" duct length or air conditioner unit installation. Operating parameters of air conditioner unit 100 may be defaulted or programmed for this standard installation for optimal system performance. By contrast, indoor duct 172 may frequently have alternate installations with longer, more restrictive ducts, e.g., as shown by the dotted lines in FIG. 3. Under such installations, duct lengths may be longer than the standard length (e.g. identified generally by extended length 176), may include more flow restrictions (e.g. identified generally by reference numeral 178), or may otherwise tend to restrict airflow more than in the standard installation. Notably, when air conditioner unit 100 uses "standard operating parameters" with such an extended duct installation, system inefficiencies and performance degradation may result. Aspects of the present subject matter are directed to detecting such a restrictive duct condition and adjusting the operating parameters of air conditioner unit 100 to accommodate or compensate for such an extended or restricted duct installation.

Now that the construction of air conditioner 100 and the configuration of controller 158 according to exemplary embodiments have been presented, an exemplary method 200 of operating an air conditioner will be described. Although the discussion below refers to the exemplary method 200 of operating air conditioner 100, one skilled in the art will appreciate that the exemplary method 200 is applicable to the operation of a variety of other air conditioner appliances, such as PTACs or split heat pump systems. In exemplary embodiments, the various method steps as disclosed herein may be performed by controller 158 or a separate, dedicated controller.

Figure 4:
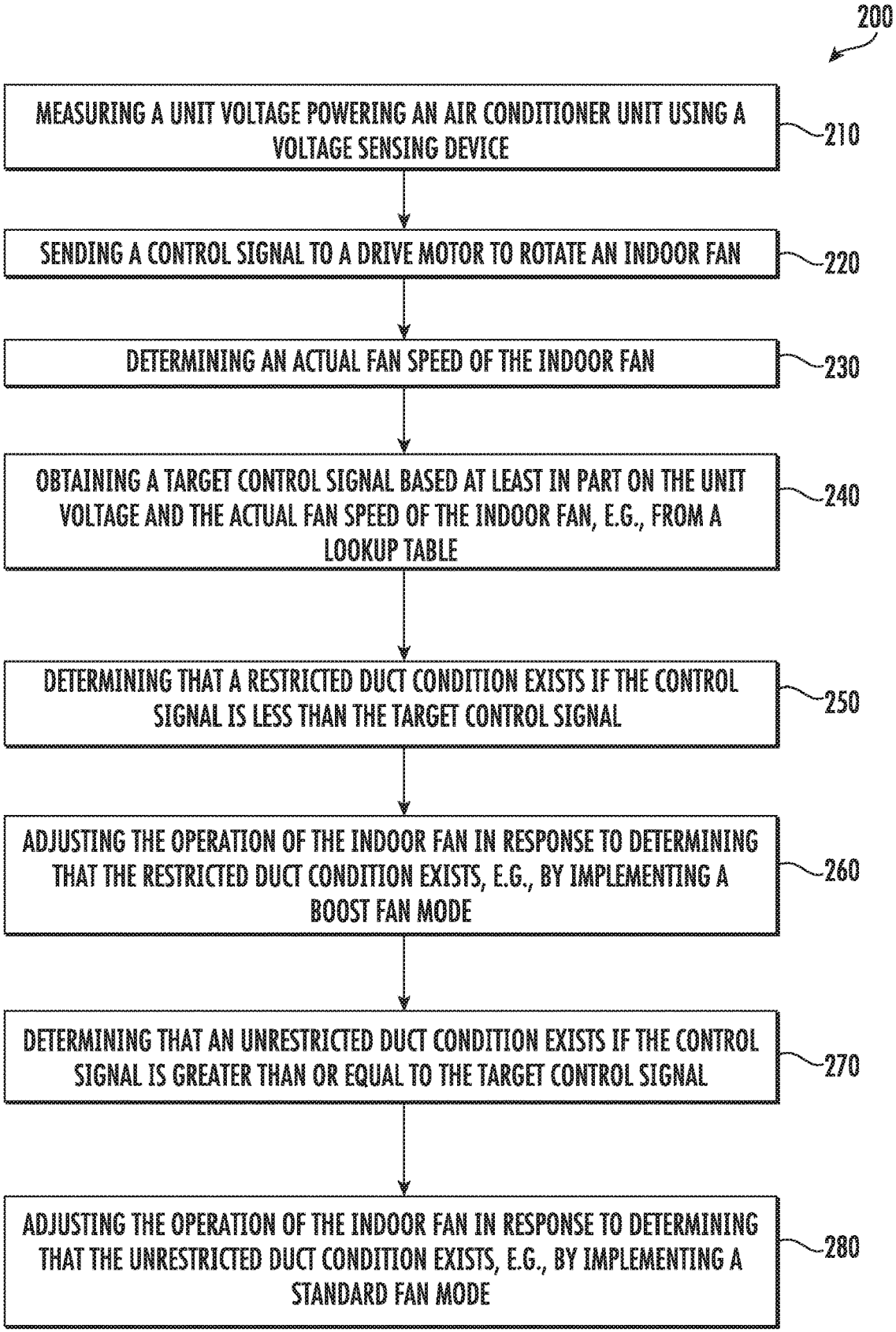
FIG. 4 illustrates a method for controlling an air conditioning appliance in accordance with one embodiment of the present disclosure.

Referring now to FIG. 4, method 200 includes, at step 210, measuring a unit voltage powering an air conditioner unit using a voltage sensing device. In this regard, for example, voltage sensing device 170 may be coupled to controller 158 or to an electrical connection between controller 158 and external power source 168. Accordingly, voltage sensing device 170 may generally be configured for monitoring the appliance or unit voltage. Notably, such unit voltage may affect the speed of indoor fan 142 for a given control signal. Therefore, monitoring the unit voltage may facilitate improved regulation and control of indoor fan 142 and other components of air conditioner appliance 100.

Step 220 includes sending a control signal to a drive motor to rotate an indoor fan. Continuing the example from above, controller 158 may supply a control signal to drive motor 166 to control the rotation of the indoor fan 142. As explained above, the term control signal may refer to an input voltage, such as a 0 to 5 V signal with 0 Volts corresponding to a stationary motor and 5 Volts corresponding to full rated power of drive motor 166. According to alternative embodiments, control signal may refer to the actual voltage applied to drive motor 166, to a pulse with modulated waveform that regulates motor speed, or to any other signal or voltage for regulating motor speed. Notably, the control signal may be selected in part to achieve a desired fan speed, and method 200 may include determining that the indoor fan 142 has reached a stable speed before detecting duct restrictions, e.g., as explained in detail with reference to steps 230 through 250 below.

After the control signal has been used to increase the speed of indoor fan 142, step 230 may include determining an actual fan speed of the indoor fan. In this regard, the actual fan speed of indoor fan 142 may be determined, e.g., using a tachometer, based on the back EMF of drive motor 166, or using any other suitable speed detection method. Notably, controller 158 may store empirically determined data that associates a particular control signal (and other factors such as unit voltage described herein) with an expected fan speed. Aspects of the present subject matter utilize differences between the actual fan speed and the expected fan speed for a given control signal to determine that a duct is extended, includes restrictions, or otherwise reduces the airflow to an extent that it is desirable to compensate for such restrictions.

Specifically, step 240 includes obtaining a target control signal based at least in part on the unit voltage and the actual fan speed of the indoor fan. For example, controller 158 may include or have access to a lookup table or database that includes empirically or theoretically determined values associating one or more factors such as control signal and unit voltage to an expected fan speed. Thus, using the actual fan speed determined at step 230, controller 158 may approximate the expected control signal to achieve that actual fan speed, e.g., referred to herein as the "target control signal." By comparing the actual control signal to the target control signal, controller 158 may diagnose or detect restrictions within indoor duct 172. It should be appreciated that step 240 may include obtaining a target control signal based solely on the actual fan speed of the indoor fan. According to alternative embodiments, step 240 may incorporate other factors in determining the target control signal, such as unit voltage.

Step 250 includes determining that a restricted duct condition exists if the control signal is less than the target control signal. Alternatively, as described below, it may be determined that a restricted duct condition exists if the control signal is simply different than the target control signal Therefore, if the control signal used at step 220 to rotate the indoor fan is less than the target control signal determined at step 240, controller 158 may determine that indoor duct 172 is restricting airflow, e.g., due to an extended length 176, a restriction 178, or some other restricting mechanism. In the event a restricted duct condition is diagnosed, step 260 may include adjusting the operation of the indoor fan in response to determining that the restricted duct condition exists, e.g., to compensate for the restriction. In general, adjusting the operation of the indoor fan may include any parameter adjustments of air conditioner unit 100 which might affect the rotational speed or airflow generated by indoor fan 142.

Although the exemplary embodiment above involves determining that a restricted duct condition exists if the control signal is less than the target control signal, it should be appreciated that according to alternative embodiments, the control signal when restricted may be larger or smaller than the target control signal. For example, this may be due to the type of fan used, such as with an axial fan, where the control signal might increase when restricted. Thus, step 250 may involve determining that a restricted duct condition exists if there is any difference between the control signal and the target control signal. It should be appreciated that difference thresholds that trigger a restricted duct condition may be set by the manufacturer, may be determined empirically, or may be manipulated by a user of the unit.

For example, according to an exemplary embodiment, adjusting the operation of indoor fan in response to a restricted duct condition may include implementing a boost fan mode, e.g., where average fan speeds are increased by a predetermined amount. For example, according to an exemplary embodiment, the boost fan mode implements a boost fan speed schedule that is greater on average than a standard fan speed schedule by at least 5 revolutions per minute (RPM), by at least 10 RPM, by at least 50 RPM, by at least 100 RPM, by at least 200 RPM, by at least 500 RPM, by at least 1000 RPM, or greater. In this regard, the standard speed schedule may include predetermined fan speeds selected for optimum system performance given a particular set of system conditions. For example, the standard fan speed schedule may include operating indoor fan 142 at 800 RPM while compressor 126 is running. By contrast, when a restricted duct condition exists and controller 158 implements the boost fan mode, the boost fan speed schedule may include operating indoor fan 142 at 1000 RPM while compressor 126 is running. It should be appreciated that these fan schedules are only exemplary and may depend on numerous variables and operating parameters.

In general, the control signal may be indicative of the flow restriction within indoor duct 172 for a variety of reasons. When a fan is controlled to a constant fan RPM and the indoor duct is restricted, the volumetric flow rate of air is reduced. Depending on the type of fan that is used, the shape of the blade, and the general system construction, the control signal may increase or decrease due to the reduced airflow. The illustrated exemplary embodiment uses a centrifugal fan blade positioned within a scroll housing and a heat exchanger upstream of the fan and outlet duct downstream of the fan. Empirical data shows that as the outlet duct is restricted, the control signal must be decreased in order to maintain a constant fan RPM. Other suitable fans may be used which may result in different control signal variations while remaining within the scope of the present subject matter.

Method 200 may further include, at step 270, determining that an unrestricted duct condition exists if the control signal is greater than or equal to the target control signal. In this regard, when the actual fan speed measured at step 230 indicates that a target control signal should be used and that the actual control signal is equal to the target signal, controller 158 may determine that indoor duct 172 is not restricted or is otherwise a standard duct configuration. Step 280 may include adjusting the operation of the indoor fan in response to determining that the unrestricted duct condition exists, e.g., by implementing the standard fan mode corresponding to standard operating conditions. In this regard, if controller 158 determines that the indoor duct 172 is not restricted, controller 158 may implement the standard fan schedule, i.e., instead of the boost schedule.

FIG. 4 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 are explained using air conditioning appliance 100 as an example, it should be appreciated that these methods may be applied to the operation of any suitable air conditioning appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioner unit defining a vertical, a lateral, and a transverse direction, the air conditioner unit comprising:

a bulkhead positioned within a cabinet and defining an indoor portion and an outdoor portion;

an indoor fan including a drive motor for selectively rotating the indoor fan to urge a flow of air through the indoor portion; and a controller operably coupled to the indoor fan, the controller being configured for:

sending a control signal to the drive motor to rotate the indoor fan;

determining an actual fan speed of the indoor fan;

obtaining a target control signal based at least in part on the actual fan speed of the indoor fan;

determining that a restricted duct condition exists if the control signal is different than the target control signal; and adjusting the operation of the indoor fan in response to determining that the restricted duct condition exists.

2. The air conditioner unit of claim 1, wherein the controller is further configured for:

measuring a unit voltage powering the air conditioner unit, wherein the target control signal is based at least in part on the unit voltage.

3. The air conditioner unit of claim 2, further comprising:

a voltage sensing device for measuring the unit voltage.

4. The air conditioner unit of claim 1, wherein the target control signal is obtained from a lookup table or database.

5. The air conditioner unit of claim 1, wherein the actual fan speed is determined using a tachometer.

6. The air conditioner unit of claim 1, wherein the actual fan speed is determined based on the back electromotive force (EMF) of the drive motor.

7. The air conditioner unit of claim 1, wherein the control signal is a 0 to 5-volt signal, with 5 volts corresponding to full rated power of the drive motor.

8. The air conditioner unit of claim 1, wherein the controller is further configured for:

determining that the indoor fan has reached a stable speed before determining the actual fan speed.

9. The air conditioner unit of claim 1, wherein adjusting the operation of the indoor fan in response to determining that the restricted duct condition exists comprises:

implementing a boost fan mode in response to determining that the restricted duct condition exists.

10. The air conditioner unit of claim 9, wherein the boost fan mode is stored as a lookup table.

11. The air conditioner unit of claim 9, wherein the boost fan mode implements a boost fan speed schedule that is greater on average than a standard fan speed schedule by at least 15 revolutions per minute.

12. The air conditioner unit of claim 1, wherein the controller is further configured for:

determining that an unrestricted duct condition exists if the control signal is greater than or equal to the target control signal; and adjusting the operation of the indoor fan in response to determining that the unrestricted duct condition exists.

13. The air conditioner unit of claim 12, wherein adjusting the operation of the indoor fan in response to determining that the unrestricted duct condition exists comprises:

implementing a standard fan mode in response to determining that the unrestricted duct condition exists, wherein the standard fan mode implements a standard fan speed schedule that is less on average than a boost fan speed schedule by at least 15 revolutions per minute.

14. A method of operating an indoor fan of an air conditioner unit, the indoor fan including a drive motor for selectively rotating the indoor fan to urge a flow of air through an indoor portion of the air conditioner unit, the method comprising:

sending a control signal to the drive motor to rotate the indoor fan;

determining an actual fan speed of the indoor fan;

obtaining a target control signal based at least in part on the actual fan speed of the indoor fan;

determining that a restricted duct condition exists if the control signal is different than the target control signal; and adjusting the operation of the indoor fan in response to determining that the restricted duct condition exists.

15. The method of claim 14, further comprising:

measuring a unit voltage powering the air conditioner unit, wherein the target control signal is based at least in part on the unit voltage.

16. The method of claim 14, further comprising:

determining that the indoor fan has reached a stable speed before determining the actual fan speed.

17. The method of claim 14, wherein adjusting the operation of the indoor fan in response to determining that the restricted duct condition exists comprises:

implementing a boost fan mode in response to determining that the restricted duct condition exists.

18. The method of claim 17, wherein the boost fan mode implements a boost fan speed schedule that is greater on average than a standard fan speed schedule by at least 15 revolutions per minute.

19. The method of claim 14, further comprising:

determining that an unrestricted duct condition exists if the control signal is greater than or equal to the target control signal; and adjusting the operation of the indoor fan in response to determining that the unrestricted duct condition exists.

20. The method of claim 19, wherein adjusting the operation of the indoor fan in response to determining that the unrestricted duct condition exists comprises:

implementing a standard fan mode in response to determining that the unrestricted duct condition exists, wherein the standard fan mode implements a standard fan speed schedule that is less on average than a boost fan speed schedule by at least 15 revolutions per minute.

* * * * *